US005615888A

United States Patent [19]

Lofink et al.

[11] Patent Number: 5,615,888

[45] Date of Patent: Apr. 1, 1997

[54] SPANISH TWENTY-ONE CARD GAME METHOD OF PLAY

[76] Inventors: Richard Lofink; Kurt Lofink, both of P.O. Box 33388, Las Vegas, Nev. 89133

[21] Appl. No.: 633,876

[22] Filed: Apr. 10, 1996

Related U.S. Application Data

[60] Continuation-in-part of provisional application No. 60/002,991 filed Aug. 28, 1995.

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS

| | | | |
|---|---|---|---|
| 4,861,041 | 8/1989 | Jones et al. | 273/292 |
| 5,549,300 | 8/1996 | Sardarian | 273/292 |

OTHER PUBLICATIONS

Scarne's Encyclopedia of Games by John Scarne, "Pontoon", Farmer, Seven–and–a–Half, pp. 286–289, Harper & Row Publishers, 1973.

"Blackjack: Progressive Bonuses" Pi Yee Press, 1985.

*Primary Examiner*—Benjamin H. Layno

*Attorney, Agent, or Firm*—John Edward Roethel

[57] ABSTRACT

A method of playing Twenty-One using a forty-eight card deck of cards comprising the Aces through the Nines and the Jacks, Queens and Kings. The elimination of only the four ten-spot cards (or only any four cards having a numerical count of ten) makes card counting much more difficult for the professional card player. Preferably multiple decks, up to six decks, of these forty-eight card decks are used. The elimination of the four ten-spot cards tips the odds of the game toward the house. To make up for this difference and keep the game attractive to the players the method of play is modified to provide liberal game rules and bonus payouts on the player's hand. The liberal game rules include allowing players to make double down wagers at any time regardless of the number of cards held by the player, and allowing the player to take back the amount of the player's double down wager if the player's numerical hand count does not exceed twenty-one and if the player is dissatisfied with his hand. The bonus payouts include paying a bonus to a player if the player's first two cards are Blackjack regardless of the numerical count of the dealer's two cards, and declaring the player to have a winning hand if the numerical count of the player's hand is twenty-one regardless of the numerical count of the dealer's hand.

31 Claims, No Drawings

SPANISH TWENTY-ONE CARD GAME METHOD OF PLAY

CROSS-REFERENCE TO RELATED APPLICATION

This application is a Continuation-in-Part of provisional application Ser. No. 60/002,991, filed Aug. 28, 1995, entitled "Spanish Twenty-One Card Game."

This invention relates to a card game, and more particularly to a card game based on Twenty-One but using a modified deck of cards having 48 cards (the tens are eliminated) and to be known as Spanish Twenty-One.

BACKGROUND OF THE INVENTION

Conventional Twenty-One involves a game of chance between a dealer and one or more players. The object is for the player to achieve a count of his hand closer to 21 than the count of the hand of the dealer; but if the count of the player's hand goes over 21 then the player loses regardless of the final count of the dealer's hand.

The conventional manner of play of Twenty-One is as follows: A standard deck of fifty-two playing cards is used and each card counts its face value, except Aces which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try and beat the count of the dealer's hand. If the player's count exceeds 21, the player "busts." The player may "stand" on any count of 21 or less. When a player busts, he loses his wager regardless of whether or not the dealer busts.

After all of the players have taken hits or have stood on their hand, the dealer "stands" or "hits" based on pre-established rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" count. However in other gaming establishments, the dealer'stands on a "soft 17" count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts (his numerical hand count exceeds 21), the player wins regardless of the numerical count of the player's hand. If neither the player nor the dealer has busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager equal to the amount of his initial ante. The dealer deals to the player one additional card and the resulting three card hand establishes the numerical count for the player's hand. The most widely used "Doubling Down" rules permit the player to "double down" only on 10 or 11 counts. Other variations allow players to "double down " on 9, 10 or 11; only on 11; or on any two cards.

Another well-known procedure is "Splitting Pairs." If the player's first two cards are a pair, the player may "split" those cards into two separate hands. His original ante is applied to one of the hands and he makes an additional ante for the other hand. The player receives a new second card for each of the split hands. Each of the split hands is played separately and the player proceeds by standing or taking hits until he has achieved a hand count upon which he wishes to stand or busts. However, if a player has split a pair of Aces, the player only receives one new card on each Ace; unless the new card is another Ace, in which case the player may again split the Aces and receive one new card on each Ace.

The player may "double down " on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting".

Another well-known procedure is "Insurance." If the dealer's up card is an Ace, the player may make an additional "insurance" bet. The insurance bets are made after each player receives his first two cards and the dealer reveals his up card and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a two-card 21 count, the player loses on his original ante but wins two-to-one odds on his second "insurance" bet. Also if the dealer has a two-card 21 count, that round of the game is over and all players lose except those who also have two-card 21 counts who tie or "push" with the dealer. If the dealer does not have a two-card 21 count, the player loses on his "insurance " bet and the round of the game continues.

As used in this disclosure and the accompanying claims, the terms "conventional Twenty-One" and "the conventional manner of play of Twenty-One" mean the game of Twenty-One as previously described and also including any of the known variations of the game of Twenty-One.

Twenty-One has remained remarkably unchanged over the years. There have been a few other modifications proposed to the basic game, but none of these modifications have achieved universal popularity. For example, in the conventional manner of play of a Twenty-One game, the dealer'shows one (the "up" card) of his first two cards and the other card (the "hole" card) is kept hidden until all the players have drawn to their hands. One modification involves the dealer'showing both of his cards face-up before the players draw. This improves the player's odds of winning and the payout odds have been modified to adjust for this change so that the house's advantage remains.

There is a need for a modified method of play of conventional Twenty-One which restores some of the fun and excitement to the game by using liberal payouts and play options that are normally not available under the conventional manner of play of Twenty-One. The method of play of the present invention will maintain a specified house advantage on the order of the house advantage enjoyed in conventional Twenty-One and, at the same time, the method of play is unfavorable to professional card players who using card counting methods to tip the advantage of the game to their favor.

All of these goals are achieved by the elimination of the four ten-spot cards from a conventional 52 card deck of playing cards. This results in a forty-eight card deck of cards comprising the Aces through the nines and the Jacks, Queens and Kings. The elimination of the four ten-spot cards makes card counting much more difficult for the professional card player.

The elimination of the four ten-spot cards also tips the odds of the game quite noticeably toward the house. To offset this change in the odds, the method of play is modified to provide liberal game rules and bonus payouts on the original hand. The result of these modifications to the method of play results in a player receiving some form of an advantage approximately once every eight hands of play.

In the preferred embodiment of the present invention, these rule modifications can take the form of:

1) paying all player Blackjacks (a two card combination equaling a numerical count of 21) at three-to-two odds, including those occurring even if the dealer also has a Blackjack. Under the conventional manner of play of Twenty-One, the player's hand would be a push if both the player and the dealer had a Blackjack.
2) paying the player's original bet at one-to-one odds if the player's hand has a numerical count of 21 even if the dealer also has a hand having a numerical count of 21. Under the conventional manner of play of Twenty-One, the player's hand would be a push if both the player and the dealer each had a hand having a numerical count of 21.
3) allowing the player to double down on any two or more cards. Under the conventional manner of play of Twenty-One, the player may only double down on his first two cards (and some gaming establishments only allow doubling down if the first two cards have a numerical count of 10 or 11). This doubling down would be permitted even after the player has split pairs, up to a maximum of four hands.
4) in certain situations, allowing the player to rescue his double down wager (known as "Double Down Rescue"). After effecting a double down and receiving the third card, a player who is dissatisfied with his non-busted hand may take back (or rescue) the doubled portion of his wager and forfeit his original wager and concede his hand. Alternatively, the player could be given the option of simply taking back (or rescuing) the doubled portion of his wager and continuing the play of the game. This double down rescue option is not available to the player if the third card causes the player's numerical hand count to exceed 21.
5) bonus payouts are added to the method of play. If the player achieves one of a group of pre-designated card combinations during the play of his hand, he receives the associated bonus payout based on a pre-established payout schedule.

The method of the present invention still includes the conventional manner of play of Twenty-One with regard to Insurance wagers being allowed and the dealer hitting any hand that has a numerical count of a soft 17 or lower. Alternatively, the method can also include the conventional manner of play of Twenty-one in those gaming establishments that mandate that the dealer' stand on soft 17 or higher. The conventional "Surrender" option is also available in which the player may reclaim half of his original wager by surrendering his hand after the dealer checks to see if the dealer's hand is a Blackjack.

The method of the present invention is seen to offer advantages to both the player and the house. The player will be receiving more entertainment value for his wager and will have the possibility of receiving bonus payouts up to three times the amount of his original wager. The player will also enjoy having the additional wagering opportunities offered by the liberalized doubling down and splitting rules.

The house will witness its patrons having more fun and an enjoyable time which will result in more drop and return business. At the same time, the house can feel comfortable knowing that professional card counters cannot obtain an advantage under this method of play.

It is an object of the present invention to provide a variation of the conventional manner of play of Twenty-one which will not only increase the player enjoyment of the game and provide for higher payouts to the player but also eliminate any advantage that a professional card counter may obtain by counting the cards during the play of conventional Twenty-One.

It is a feature of the present invention to use a deck of playing cards that comprise a standard 52 card with the ten-spot cards eliminated, resulting in a 48 card deck. Various modifications are made to play of conventional Twenty-One to adjust for the fact that the four ten-spot cards have been eliminated.

It is an advantage of the present invention that a new and more exciting casino game has been created which increase player activity and generate additional revenues to the house.

Other objects, features and advantages of the present invention will become apparent from a consideration of the following detailed description.

SUMMARY OF THE INVENTION

A forty-eight card deck of cards comprising the Aces through the Nines and the Jacks, Queens and Kings is used in the method of play. The elimination of the four ten-spot cards makes card counting much more difficult for the professional card player. In the preferred embodiment of the present invention, multiple decks of these forty-eight card decks may be used.

Because the elimination of the four ten-spot cards tips the odds of the game toward the house, the method of play is modified to provide liberal game rules and bonus payouts on the player's hand. The result of these modifications to the method of play results in a player receiving some form of an advantage approximately once every eight hands of play.

DETAILED DESCRIPTION OF THE PREFERRED EMBODIMENTS

In the preferred embodiment of the present invention, a forty-eight card deck of cards comprising the Aces through the Nines and the Jacks, Queens and Kings is used in the method of play. In the preferred embodiment of the present invention, multiple decks of these forty-eight card decks are shuffled together and used to deal the hands to the players and the dealer. Up to six decks are used, although the method of the present invention can be practiced using as few as a single deck of these forty-eight card decks. In a preferred embodiment of the present invention, a minimum of three decks should be used for full bonus payouts as described later herein.

The method of the present invention uses this modified deck of playing cards and the conventional manner of play of Twenty-One as modified with one or more of the following changes to the rules. As in conventional Twenty-one, each player makes a wager to be eligible to participate in the game. Conventional dealing procedures are used which result in each player having two cards and the dealer having an up card and a down card.

Play proceeds as in the conventional manner of play of Twenty-One with each player determining whether make an Insurance Bet, if appropriate; whether to split pairs, if appropriate; whether to Double Down or simply whether to stand or take hits to receive additional cards. Once all players have played their hands and have stood or busted, the dealer plays out his hand according to the conventional manner of play including the particular procedures of the gaming establishment relating to the hitting or staying of the dealer on hands of "soft 17". Once the dealer's final hand count is determined, winning wagers are paid and losing wagers are collected by the dealer.

Because the elimination of the four ten-spot cards from each conventional fifty-two card deck results in changing the mathematical odds of the game in favor of the house, the method of the present invention modifies the conventional manner of play of Twenty-One in order to move these mathematical odds closer to the mathematical odds that are present in conventional Twenty-One. These rule modifications can take various forms:

Form 1: All player Blackjacks (a two card combination equally a numerical count of 21) are paid at three-to-two odds, including those occurring even if the dealer also has a Blackjack. Under the conventional manner of play of Twenty-One, the player's hand would be a push if both the player and the dealer had a Blackjack.

Form 2: The player's original bet is paid at one-to-one odds if the player's hand has a numerical count of 21 even if the dealer also has a hand having a numerical count of 21. Under the conventional manner of play of Twenty-One, the player's hand would be a push if both the player and the dealer each had a hand having a numerical count of 21.

Form 3: A player is allowed to double down on any two or more cards. Under the conventional manner of play of Twenty-One, the player may only double down on his first two cards (and some gaming establishments only allow doubling down if the first two cards have a numerical count of 10 or 11). This doubling down would be permitted even after the player has split pairs, up to a maximum of four hands.

Form 4: A player is allowed to rescue his double down wager (known as "Double Down Rescue"). After effecting a double down and receiving the third card, a player who is dissatisfied with his non-busted hand may take back (or rescue) the doubled portion of his wager and forfeit his original wager and concede his hand. This double down rescue option is not available to the player if the third card causes the player's numerical hand count to exceed 21.

Form 5: Bonus payouts are added to the method of play. If the player achieves any of the following card combinations during the play of his hand, he receives the associated bonus payout shown in Table 1:

TABLE 1

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1 |

An additional super bonus may also be added to the play of the game. Whenever a player receives three 7's of the same suit and the dealer's up card is also a 7, the player receives an additional bonus payout. In the preferred embodiment, this bonus payout would be $5,000 for a minimum bet of $25 and $1,000 for lower wagers. An "Envy Bonus" is also paid to the other players at the gaming table whenever a player wins this super bonus. In the preferred embodiment, the Envy Bonus would be $50 to each player.

The method of the present invention still includes the conventional manner of play of Twenty-One with regard to Insurance wagers being allowed and the dealer hitting any hand that has a numerical count of a soft 17.

While the invention has been illustrated with respect to several specific embodiments thereof, these embodiments should be considered as illustrative rather than limiting. Various modifications and additions may be made and will be apparent to those skilled in the art.

For example, the feature of the present invention in which the player can rescue his double down wager (the Double Down Rescue described above) can also be applied to a conventional Twenty-One game. That is, the conventional manner of play of Twenty-One using one or more standard fifty-two card decks can be modified by providing the player with the option to rescue the doubled portion of his wager after receiving the extra card. Depending on which rule of play is in place, the player rescuing the doubled portion of his wager must forfeit his original wager and concede his hand or, alternatively, the player may simply rescue the doubled portion of his wager and continue with the play of the hand. The double down rescue option would not be available to the player if the third card causes the player's numerical hand count to exceed 21.

The method of the present invention is not limited to live table game versions of Twenty-One. Any of the methods described above can be applied to a Twenty-One game that is programmed to operate on an electronic video gaming machine that displays Twenty-One to a player and the player effects the play of the game using control buttons or the like. Each of the features discussed above can be easily included in any electronic version of Twenty-One and the claims of the present invention are intended to include both the live table game version and the electronic video gaming machine version of the method of the present invention.

Accordingly, the invention should not be limited by the foregoing description, but rather should be defined only by the following claims.

What is claimed is:

1. A method of playing a modified version of Twenty-One which uses the conventional manner of play of Twenty-One with various rule modifications comprising:

a) providing at least one deck of forty-eight cards consisting essentially of four Aces, four twos, four threes, four fours, four fives, four sixes, four sevens, four eights, four nines, four Jacks, four Queens, four Kings and four Aces;

b) a player making a wager to be eligible to play a hand;

c) a dealer dealing two cards to the player and two cards to the dealer, one of the dealer's cards being face up;

d) if the player's two cards are a Blackjack, paying the player three-to-two odds on the amount of his wager regardless of the numerical value of the dealer's two cards;

e) the player standing on his first two cards or drawing additional cards, as desired;

f) allowing the player to make an additional Double Down wager at any time regardless of the number of cards held by the player;

g) allowing the player to split any cards that are a pair and to make a Double Down wager on any hand that is created by the split of the pairs;

h) the dealer' standing or drawing additional cards according to the conventional manner of play of Twenty-One;

i) declaring the player to have a winning hand if the numerical count of the player's hand is twenty-one regardless of the numerical count of the dealer's hand;

j) otherwise determining whether the player's hand is a winning hand according to conventional manner of play of Twenty-One; and k) paying the player based on the amount of the player's wagers if the player has a winning hand.

2. The method of claim 1 further including, if the player is dissatisfied with his numerical hand count after receiving his Double Down card, allowing the player to take back the amount of his Double Down wager if the player's numerical hand count does not exceed twenty-one.

3. The method of claim 1 further including paying the player bonus payouts if the player achieves a predetermined card combination in the player's hand.

4. The method of claim 3 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

5. A method of playing a modified version of Twenty-One which uses the conventional manner of play of Twenty-One with various rule modifications comprising:

a) providing at least one deck of forty-eight cards consisting essentially of the standard fifty-two card deck with four of the ten count cards removed;

b) a player making a wager to be eligible to play a hand;

c) a dealer dealing two cards to the player and two cards to the dealer, one of the dealer's cards being face up;

d) if the player's two cards are a Blackjack, paying the player three-to-two odds on the amount of his wager regardless of the numerical value of the dealer's two cards;

e) the player standing on his first two cards or drawing additional cards, as desired;

f) allowing the player to make an additional Double Down wager at any time regardless of the number of cards held by the player;

g) allowing the player to split any cards that are a pair and to make a Double Down wager on any hand that is created by the split of the pairs;

h) the dealer' standing or drawing additional cards according to the conventional manner of play of Twenty-One;

i) declaring the player to have a winning hand if the numerical count of the player's hand is twenty-one regardless of the numerical count of the dealer's hand;

j) otherwise determining whether the player's hand is a winning hand according to conventional manner of play of Twenty-One; and k) paying the player based on the amount of the player's wagers if the player has a winning hand.

6. The method of claim 5 further including, if the player is dissatisfied with his numerical hand count after receiving his Double Down card, allowing the player to take back the amount of his Double Down wager if the player's numerical hand count does not exceed twenty-one.

7. The method of claim 5 further including paying the player bonus payouts if the player achieves a predetermined card combination in the player's hand.

8. The method of claim 7 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

9. A method of playing a modified version of Twenty-One which uses the conventional manner of play of Twenty-One with various rule modifications comprising:

a) providing at least one deck of forty-eight cards consisting essentially of four Aces, four twos, four threes, four fours, four fives, four sixes, four sevens, four eights, four nines, four Jacks, four Queens, four Kings and four Aces;

b) a player making a wager to be eligible to play a hand;

c) a dealer dealing two cards to the player and two cards to the dealer, one of the dealer's cards being face up;

d) if the player's two cards are a Blackjack, paying the player three-to-two odds on the amount of his wager regardless of the numerical value of the dealer's two cards;

e) continuing the play of the hand according to the conventional manner of play of Twenty-One;

f) otherwise determining whether the player's hand is a winning hand according to conventional manner of play of Twenty-One; and g) paying the player based on the amount of the player's wage if the player has a winning hand.

10. The method of claim 9 further including paying the player bonus payouts if the player achieves a predetermined card combination in the player's hand.

11. The method of claim 10 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

12. A method of playing a modified version of Twenty-One which uses the conventional manner of play of Twenty-One with various rule modifications comprising:

a) providing at least one deck of forty-eight cards consisting essentially of the standard fifty-two card deck with four of the ten count cards removed;

b) a player making a wager to be eligible to play a hand;

c) a dealer dealing two cards to the player and two cards to the dealer, one of the dealer's cards being face up;

d) if the player's two cards are a Blackjack, paying the player three-to-two odds on the amount of his wager regardless of the numerical value of the dealer's two cards;

e) continuing the play of the hand according to the conventional manner of play of Twenty-One;

f) otherwise determining whether the player's hand is a winning hand according to conventional manner of play of Twenty-One; and g) paying the player based on the amount of the player's wager if the player has a winning hand.

13. The method of claim 12 further including paying the player bonus payouts if the player achieves a predetermined card combination in the player's hand.

14. The method of claim 13 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

15. A method of playing a modified version of Twenty-One which uses the conventional manner of play of Twenty-One with various rule modifications comprising:

a) providing at least one deck of forty-eight cards consisting essentially of four Aces, four twos, four threes, four fours, four fives, four sixes, four sevens, four eights, four nines, four Jacks, four Queens, four Kings and four Aces;

b) a player making a wager to be eligible to play a hand;

c) a dealer dealing two cards to the player and two cards to the dealer, one of the dealer's cards being face up;

d) the player standing on his first two cards or drawing additional cards, as desired;

e) the dealer'standing or drawing additional cards according to the conventional manner of play of Twenty-One;

f) declaring the player to have a winning hand if the numerical count of the player's hand is twenty-one regardless of the numerical count of the dealer's hand;

g) otherwise determining whether the player's hand is a winning hand according to conventional manner of play of Twenty-One; and h) paying the player based on the amount of the player's wager if the player has a winning hand.

16. The method of claim 15 further including paying the player bonus payouts if the player achieves a predetermined card combination in the player's hand.

17. The method of claim 16 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

18. A method of playing a modified version of Twenty-One which uses the conventional manner of play of Twenty-One with various rule modifications comprising:

a) providing at least one deck of forty-eight cards consisting essentially of the standard fifty-two card deck with four of the ten count cards removed;

b) a player making a wager to be eligible to play a hand;

c) a dealer dealing two cards to the player and two cards to the dealer, one of the dealer's cards being face up;

d) the player standing on his first two cards or drawing additional cards, as desired;

e) the dealer'standing or drawing additional cards according to the conventional manner of play of Twenty-One;

f) declaring the player to have a winning hand if the numerical count of the player's hand is twenty-one regardless of the numerical count of the dealer's hand;

g) otherwise determining whether the player's hand is a winning hand according to conventional manner of play of Twenty-One; and h) paying the player based on the amount of the player's wager if the player has a winning hand.

19. The method of claim 18 further including paying the player bonus payouts if the player achieves a predetermined card combination in the player's hand.

20. The method of claim 19 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

21. A method of playing a modified version of Twenty-One which uses the conventional manner of play of Twenty-One with various rule modifications comprising:

a) providing at least one deck of forty-eight cards consisting essentially of four Aces, four twos, four threes, four fours, four fives, four sixes, four sevens, four eights, four nines, four Jacks, four Queens, four Kings and four Aces;

b) a player making a wager to be eligible to play a hand;

c) a dealer dealing two cards to the player and two cards to the dealer, one of the dealer's cards being face up;

d) allowing the player to make an additional Double Down wager at any time regardless of the number of cards held by the player;

e) the player standing on his first two cards or drawing additional cards, as desired;

f) the dealer'standing or drawing additional cards according to the conventional manner of play of Twenty-One;

g) determining whether the player's hand is a winning hand according to conventional manner of play of Twenty-One; and h) paying the player based on the amount of the player's wagers if the player has a winning hand.

22. The method of claim 21 further including, if the player is dissatisfied with his numerical hand count after receiving his Double Down card, allowing the player to take back the amount of his Double Down wager if the player's numerical hand count does not exceed twenty-one.

23. The method of claim 21 further including allowing the player to split any cards that are a pair and to make a Double Down wager on any hand that is created by the split of the pairs.

24. The method of claim 21 further including paying the player bonus payouts if the player achieves a predetermined card combination in the player's hand.

25. The method of claim 24 in which the bonus payouts and

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

26. A method of playing a modified version of Twenty-One which uses the conventional manner of play of Twenty-One with various rule modifications comprising:

a) providing at least one deck of forty-eight cards consisting essentially of the standard fifty-two card deck with four of the ten count cards removed;

b) a player making a wager to be eligible to play a hand;

c) a dealer dealing two cards to the player and two cards to the dealer, one of the dealer's cards being face up;

d) allowing the player to make an additional Double Down wager at any time regardless of the number of cards held by the player;

e) the player standing on his first two cards or drawing additional cards, as desired;

f) the dealer'standing or drawing additional cards according to the conventional manner of play of Twenty-One;

g) determining whether the player's hand is a winning hand according to conventional manner of play of Twenty-One; and h) paying the player based on the amount of the player's wagers if the player has a winning hand.

27. The method of claim 26 further including, if the player is dissatisfied with his numerical hand count after receiving his Double Down card, allowing the player to take back the amount of his Double Down wager if the player's numerical hand count does not exceed twenty-one.

28. The method of claim 26 further including allowing the player to split any cards that are a pair and to make a Double Down wager on any hand that is created by the split of the pairs.

29. The method of claim 26 further including paying the player bonus payouts if the player achieves a predetermined card combination in the player's hand.

30. The method of claim 29 in which the bonus payouts and predetermined card combinations are:

| Card Combination | Payout |
|---|---|
| Five card 21 | 3 to 2 |
| Six card 21 | 2 to 1 |
| Seven+ card 21 | 3 to 1 |
| 6-7-8 mixed suits | 3 to 2 |
| 6-7-8 same suit | 2 to 1 |
| 6-7-8 all Spades | 3 to 1 |
| 7-7-7 mixed suits | 3 to 2 |
| 7-7-7 same suit | 2 to 1 |
| 7-7-7 all Spades | 3 to 1. |

31. A method of playing a modified version of Twenty-One which uses the conventional manner of play of Twenty-One with various rule modifications comprising:

a) providing at least one standard deck of fifty-two cards;

b) a player making a wager to be eligible to play a hand;

c) a dealer dealing two cards to the player and two cards to the dealer, one of the dealer's cards being face up;

d) allowing the player to make an additional Double Down wager at any time regardless of the number of cards held by the player;

e) the player standing on his first two cards or drawing additional cards, as desired;

f) the dealer'standing or drawing additional cards according to the conventional manner of play of Twenty-One;

g) allowing the player to take back the amount of his Double Down wager if the player's numerical hand count does not exceed twenty-one if the player is dissatisfied with his numerical hand count after receiving his Double Down card;

h) determining whether the player's hand is a winning hand according to conventional manner of play of Twenty-One; and i) paying the player based on the amount of the player's wagers if the player has a winning hand.

* * * * *